United States Patent [19]

Dona et al.

[11] Patent Number: 4,594,778

[45] Date of Patent: Jun. 17, 1986

[54] SHAVING UNIT

[75] Inventors: Marinus J. J. Dona, Eindhoven; Adrianus J. J. Franken, Maarheeze; Freddy Haes; Cornelis M. Reynhout, both of Eindhoven, all of Netherlands

[73] Assignee: U.S. Philips Corporation, New York, N.Y.

[21] Appl. No.: 713,521

[22] Filed: Mar. 19, 1985

[30] Foreign Application Priority Data

Mar. 21, 1984 [NL] Netherlands ..... 8400887

[51] Int. Cl.[4] ..... B26B 19/04

[52] U.S. Cl. ..... 30/43.9; 30/43.6

[58] Field of Search ..... 30/43.9, 43.6

[56] References Cited

U.S. PATENT DOCUMENTS

| | | | |
|---|---|---|---|
| 2,081,366 | 5/1937 | Muros | 30/43.9 |
| 2,261,275 | 11/1941 | Pasinski | 30/43.9 |
| 2,610,395 | 9/1952 | Van Der Lee | 30/43.9 |
| 3,078,570 | 2/1963 | Vaes | 30/43.6 |
| 3,206,850 | 9/1965 | Jepson | 30/43.9 |
| 3,213,301 | 10/1965 | Jepson | 30/43.9 X |
| 3,242,357 | 3/1966 | Guichard | 30/43.9 X |

*Primary Examiner*—Jimmy C. Peters

*Attorney, Agent, or Firm*—Rolf E. Schneider

[57] ABSTRACT

A shaving unit for a dry-shaving apparatus comprises an external first cutting member with an annular wall portion formed with hair-entry apertures, and a second internal cutting member which is cooperable with the first cutting member and which comprises a ring of cutters which second cutting member can be driven relative to the first cutting member with an oscillatory rotational movement. The first and second cutting members are interconnected by at least two resilient elements, each of which extends substantially radially of the rotational axis of the second cutting member and has an end connected to the first cutting member and an end connected to the second cutting member. The elastic properties of the resilient elements are such as to permit the oscillatory rotational movement of the second cutting member, but the resilient elements are rigid in directions extending substantially parallel to and radially of the rotational axis of the second cutting member.

5 Claims, 6 Drawing Figures

SHAVING UNIT

The invention relates to a shaving unit for a dry-shaving apparatus, the shaving unit comprising an external first cutting member having an annular wall portion with hair-entry apertures, and an internal second cutting member which is cooperable with the first cutting member and which comprises a ring of cutters, which second cutting member can be driven relative to the first cutting member so as to perform an oscillatory rotational movement.

Such a shaving unit is known from for example U.S. Pat. No. 1,941,583. In this known unit the cutters of the internal second cutting member are urged against the external first cutting member by means of a spring which acts in an axial direction. This has the disadvantage that a part of the power of the drive motor is used to overcome the friction between the two cutting members whilst in addition it gives rise to wear and the generation of heat.

The invention aims at mitigating these drawbacks and is characterized in that the first and second cutting members are interconnected by at least two resilient elements, each of which has an end connected to the first cutting member and an end connected to the second cutting member and which are so arranged that their elastic properties will permit the oscillatory rotational movement of the second cutting member, but which are rigid in directions extending substantially parallel to and radially of the rotational axis of the second cutting member.

Embodiments of the invention will now be described in more detail, by way of example, with reference to the drawings.

Figure 1:
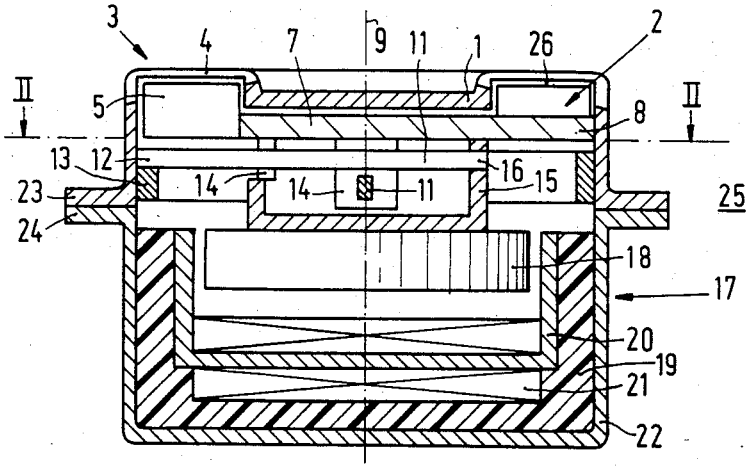
FIG. 1 is an axial sectional view of a shaving unit according to the invention comprising first and second cutting members.
Figure 2:
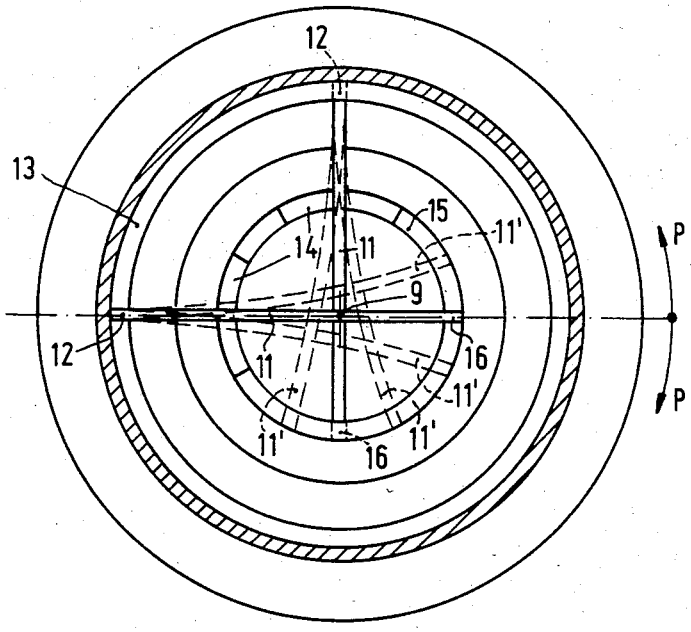
FIG. 2 is a cross-sectional view taken on the line II—II in FIG. 1.
Figure 3:
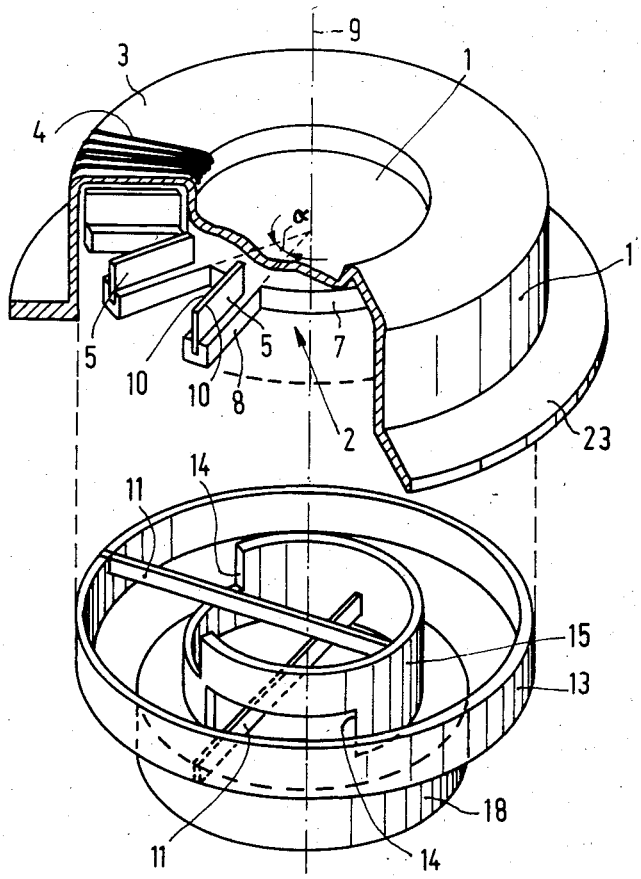
FIG. 3 is an exploded perspective view of the cutting members and the resilient elements of the shaving unit shwon in FIG. 1.

The embodiment shown in FIGS. 1, 2 and 3 comprises an external first cutting member 1 and an internal second cutting member 2. The cutting member 1 comprises an annular wall portion 3 with hair-entry apertures 4. The cutting member 2 comprises a ring of cutters 5 which is coaxial with and corresponds to the annular wall portion 3 of the cutting member 1, so that when the cutting member 2 moves rotationally about its axis 9 relative to the cutting member 1, a hair which is caught in a hair-entry aperture is severed by cooperation of a cutter 5 with the annular wall portion 3.

The cutting member 2 comprises a plastic body 7 with spokes 8 in which the cutters 5 are supported. The cutters 5, which are in the form of blades, each have a cutting edge 10 on both sides (FIG. 3).

The first and the second cutting members are interconnected by two elongate resilient elements 11 which intersect each other at right angles and which extend substantially radially of the rotational axis 9 of the cutting member 2. At one end 12 each of the resilient elements 11 is fixed in an annular member 13 which is secured to the first cutting member 1. The resilient elements 11 extend through openings 14 in a tubular member 15 and at their other ends 16 are fixed in wall portions of the member 15 which are disposed diametrically opposite the openings 14. This tubular member 15 is secured to the second cutting member 2.

For the sake of clarity the first cutting member 1 has been partly cut-away in FIG. 3 and the interconnected portions, namely the annular member 13, the resilient elements 11 and the tubular member 15, are shown separated from the cutting members 1 and 2.

The resilient elements 11 are constructed as blade springs with a high stiffness in directions extending substantially parallel to and radially of the rotational axis 9 of the cutting member 2, so that in these directions the two cutting members can only move to a very small extent relative to each other. However, the elastic properties of the blade springs permits deflection of these elements in directions extending transversely of said directions of high stiffness, as indicated by the broken lines 11' in FIG. 2. As a result of this, the second cutting member 2 has sufficient freedom to move relative to the first cutting member for performing an oscillatory rotational movement about the rotational axis 9, as indicated by the arrows P (FIG. 2). The amplitude of the oscillatory rotational movement needs only correspond to a part of a revolution but is preferably not smaller than half the angle $\alpha$ between adjacent spokes 8 (FIG. 3).

The second cutting member 2 is driven by means of a motor 17, whose rotor 18 is mounted directly on the tubular member 15. The rotor 18 comprises a disc of a permanent-magnetic material, which disc has been polarized diametrically. The stator is arranged in a housing 22 and comprises a support 19 with a yoke 20 provided with a coil 21. The first cutting member 1 and the housing 22 are secured to each other by means of their flanges 23 and 24, respectively.

By connecting the motor 17 to an electric power source and to a control mechanism, known per se, pulses can be applied to the rotor 18 via the stator 19, so that the assembly comprising the second cutting member 2, the tubular member 15 and rotor 18 will perform an oscillatory rotational movement. Preferably, the pulses are applied at the resonant frequency of this assembly. The direct connection of the rotor 18 to the second cutting member 2 by the tubular member 15 obviates the need for a transmission mechanism, for example, gear wheels, and results in a very compact shaving unit 25 comprising the cutting members, the tubular member 15 with resilient elements 11, and the motor.

Obviously, the housing 22 may be given a larger axial dimension to accommodate, for example, the above-mentioned power source and the components of the control mechanism.

In general when a hair is being cut forces occur which tend to urge the two cutting members 1 and 2 away from each other in an axial direction. The high rigidity of the resilient elements 11 in this direction will minimize axial movement of the cutting member 2 relative to the cutting member 1 as a result of these forces which occur during cutting, and will thereby promote a strong cutting action. No additional resilient element for exerting pressure on the cutting member 2 in an axial direction towards the cutting member 1 is required when the construction described above is employed.

The force with which the resilient elements 11 urge the cutting member 2 against the cutting member 1 in an axial direction can now be very small when the cutting member 2 is at rest or when it is being driven no hairs are being cut. The construction may even be such that a very narrow cutting gap 26 is formed between the cutting edges of the cutters 5 and the inner side of the annular portion 3 in which the hair-entry apertures 4 are formed, so that moving parts of the cutting member 2 are not in contact with the cutting member 1. In comparison with the construction of known shavers this leads to a substantial reduction of undesired effects such as wear, generation of heat, and noise. Another advantage is that practically no friction losses occur between the two cutting members. This enables a smaller drive motor with a smaller power rating to be used, so that the entire shaving apparatus can be lighter in weight and smaller and there is greater freedom as regards the design of the apparatus. In the case of a rechargeable or a battery-operated shaver the time before the battery has to be recharged or replaced is extended.

Obviously, more than two resilient elements may be arranged between the two cutting members.

Figure 4:
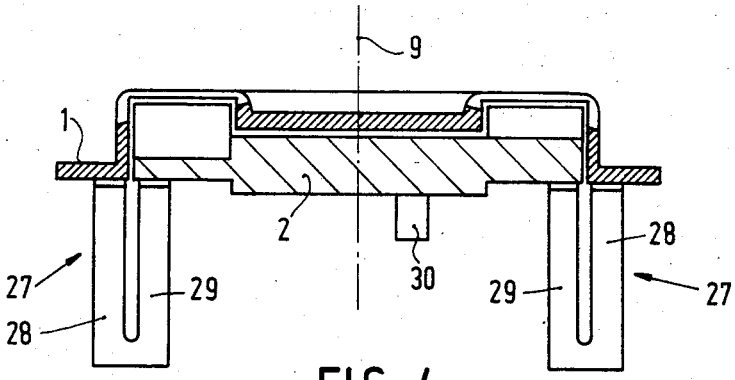
FIG. 4 is an axial sectional view of a modification of the embodiment shown in FIGS. 1 to 3.

The construction shown in FIG. 4 is a modification of the embodiment shown in FIGS. 1, 2 and 3. The resilient elements between the two cutting members are now constructed as U-shaped blade springs 27 each having limits 28 and 29 which extend in directions substantially parallel to the rotational axis 9. Again, each spring 27 has a high stiffness in directions extending substantially parallel to and radially of the rotational axis 9 but is resiliently flexible in directions extending transversely of said directions of high stiffness.

In this embodiment the free ends of the limbs 28 of the springs 27 are connected directly to the first cutting member 1 and the free ends of the limbs 29 are connected directly to the second cutting member 2. For the purpose of driving the second cutting member this member is provided with an eccentric pin 30 which may be coupled to an electric motor, for example via an eccentric mechanism, so that the second cutting member 2 can again be driven with an oscillatory rotational movement relative to the first cutting member 1.

Figure 5:
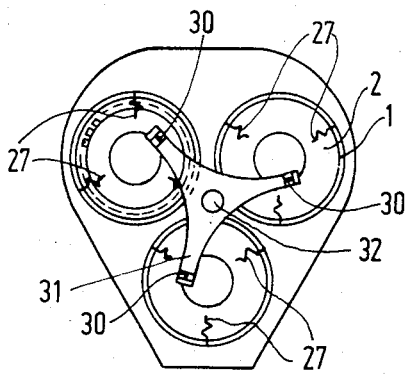
FIG. 5 is an underneath view of a shaving head of a shaving apparatus comprising three shaving units of the construction shown in FIG. 4.

FIG. 5 is a schematic underneath view of a shaving head comprising three shaving units which each comprise a first cutting member 1 and a second cutting member 2, constructed as shown in FIG. 4. The drive pins 30 of the three cutting members 2 are coupled to the arms of a three-armed coupling member 31 which is coupled at its centre 32 to, for example, an eccentric, known per se, on the shaft of an electric motor, so that as this shaft rotates the centre 32 of the coupling member follows a circular path. The three cutting members 2 are thereby driven with an oscillatory rotational motion by a single motor.

In FIG. 5 the springs 27 are shown only schematically.

Figure 6:
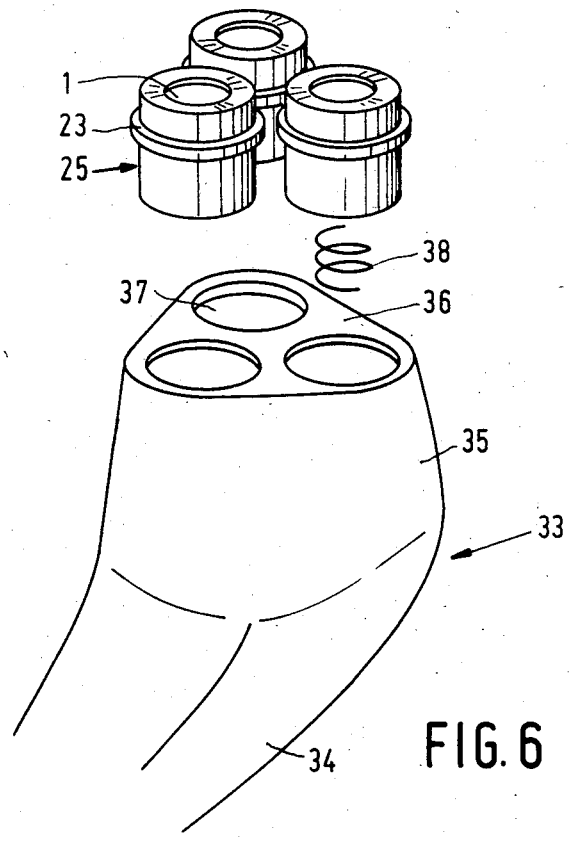
FIG. 6 is an exploded perspective view of a shaving apparatus comprising three shaving units of the construction shown in FIGS. 1 to 3.

FIG. 6 shows a shaving apparatus comprising a housing 33 and three of the shaving units 25 shown in FIGS. 1 to 3. The housing 33 comprises a grip portion 34, which can accommodate inter alia an electric power source and a shaving head 35 in which three shaving units are mounted in a triangular formation. In the assembled condition the shaving units 25 are retained in the shaving head 35 by means of a plate 36 formed with circular openings 37 through which the first cutting members 1 project, the flanges 23 of these cutting members bearing against the inner surface of the plate 36. Springs 38 resiliently support the shaving units 25 inside the shaving head.

The compact construction of the shaving units provides a substantial freedom as regards the design of shaving apparatuses comprising one or more shaving units. The shaving units can be mounted and removed very simply. The housing 33 of the shaving apparatus comprises no moving parts at all.

In the shaving unit shown in FIGS. 1 to 3 a detachable connection may be provided between the flanges 23 and 24 of the cutting members so that the units can be opened, for example for cleaning purposes.

Owing to their small dimensions and hence the low material costs, as well as the simple construction and the small number of their component parts, the shaving units can be manufactured cheaply enough to be treated as disposable products which may be replaced after some time.

What is claimed is:

1. A shaving unit for a dry-shaving apparatus, the shaving unit comprising an external first cutting member having an annular wall portion with hair-entry apertures, and an internal second cutting member which is cooperable with the first cutting member and which comprises a ring of cutters, which second cutting member can be driven relative to the first cutting member so as to perform an oscillatory rotational movement, characterized in that the first and second cutting members are interconnected by at least two resilient elements, each of which has an end connected to the first cutting member and an end connected to the second cutting member and which are so arranged that their elastic properties will permit the oscillatory rotational movement of the second cutting member, but which are rigid in directions extending substantially parallel to and radially of the rotational axis of the second cutting member.

2. A shaving unit as claimed in claim 1, characterized in that the first and second cutting members are interconnected by two resilient elements in the form of blade springs which extend substantially radially of the rotational axis of the second cutting member and which intersect each other at right angles.

3. A shaving unit as claimed in claim 1, characterized in that the first and second cutting members are interconnected by two resilient elements in the form of U-shaped blade springs which are arranged on diametrically opposite sides of the rotational axis of the second cutting member and each of which has two limbs extending in directions substantially parallel to this axis and connected one to each cutting member.

4. A shaving unit as claimed in claim 1, characterized in that the second cutting member is rigidly connected to the rotor of a drive motor.

5. A shaving apparatus comprising a plurality of shaving units as claimed in claim 1, characterized in that the second cutting members are coupled to a drive motor by means of a common coupling member.

* * * * *